US005409029A

United States Patent [19]

Davis

[11] Patent Number: 5,409,029

[45] **Date of Patent: * Apr. 25, 1995**

[54] RADIAL CRUTCH TIP ASSEMBLY

[75] Inventor: Richard C. Davis, Palm Harbor, Fla.

[73] Assignee: Trek Medical Corporation, Tampa, Fla.

[ * ] Notice: The portion of the term of this patent subsequent to Oct. 11, 2011 has been disclaimed.

[21] Appl. No.: 262,534

[22] Filed: Jun. 20, 1994

Related U.S. Application Data

[62] Division of Ser. No. 18,550, Feb. 17, 1993, Pat. No. 5,353,825.

[51] Int. Cl.[6] ..... A61H 3/02

[52] U.S. Cl. ..... 135/68; 135/84

[58] Field of Search ..... 135/77, 82, 84, 86, 135/68; 248/188.9

[56] References Cited

U.S. PATENT DOCUMENTS

| | | | |
|---|---|---|---|
| 960,700 | 6/1910 | Pratt . | |
| 2,318,017 | 4/1943 | Schmidt | 248/188.9 |
| 5,103,850 | 4/1992 | Davis | 135/84 |
| 5,301,704 | 4/1994 | Brown | 135/84 X |

FOREIGN PATENT DOCUMENTS 645650 8/1979 U.S.S.R. .

*Primary Examiner*—Lanna Mai

*Attorney, Agent, or Firm*—Griffin, Butler Whisenhunt & Kurtossy

[57] ABSTRACT

A crutch tip assembly (12) includes a crutch tip base (14) with a laterally protruding lip (28) adjacent a base bottom surface (26) and a resilient boot (16) having the shape of a rocker. The boot defines-a mounting cavity (36) for snugly receiving the base bottom surface and the lip for holding the boot on the base. The boot has a sole with a bottom surface (39) for contacting the ground and a top surface (46) in the cavity directed towards the base bottom surface. Protruding portions are positioned between the base bottom surface and the sole top surface for providing resilient cushioning between the sole top surface and the base bottom surface. Sidewall cavities (84) are located around the perimeter of the boot allowing for lateral compression and reexpansion.

5 Claims, 3 Drawing Sheets

RADIAL CRUTCH TIP ASSEMBLY

This is a divisional application of U.S. application Ser. No. 08/018,550, filed on Feb. 17, 1993, U.S. Pat. No. 5,353,825.

BACKGROUND OF THE INVENTION

This invention relates generally to the art of crutches, walkers, canes and more particularly to tip assemblies therefor.

A problem encountered by many when using ambulatory assistance devices, such as crutches, is that when they are extended at angles forwardly or backwardly, their tips do not always get adequate traction with floor surfaces, thereby slipping away from the users. This is not only annoying, but can be dangerous to users. It is therefore an object of this invention to provide a crutch tip assembly which achieves increased traction with floor surfaces when a crutch is angled outwardly in front of or behind a user as well as slightly laterally as is typical of users.

It has been suggested to place a rocker at a tip end of a crutch. For example, U.S. Pat. No. 5,103,850 to Davis describes such a radial crutch tip assembly having a crutch tip base to be attached to a crutch and a resilient boot forming a cavity for receiving the crutch tip base. Although the radial crutch tip assembly of that Davis patent provides essentially improved performance over many prior-art crutch tips, a boot thereof is still not sufficiently resilient and compliant to achieve an optimized traction. Also, it is desirable for a crutch tip to form a shock absorber, thereby protecting a user's joints and muscles and also providing more pleasant ambulatory movement, something which the radial crutch tip of U.S. Pat. No. 5,103,850 does not adequately do. For this reason, it is an object of this invention to form a boot of a radial crutch tip assembly such that it conforms to a floor surface, during use, to achieve an adequate traction and such that it forms a shock absorber which reduces shock to a user to protect his muscles and joints.

SUMMARY

According to principles of this invention, a rocker-shaped resilient boot defines a mounting cavity for receiving a crutch tip base. Protruding portions of a sole of the boot positioned between a bottom base surface and a sole top surface provide a resilient cushion between the sole and the base. In some embodiments there are cushioning cavities extending into side edges of the boot.

BRIEF DESCRIPTION OF THE DRAWING8

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
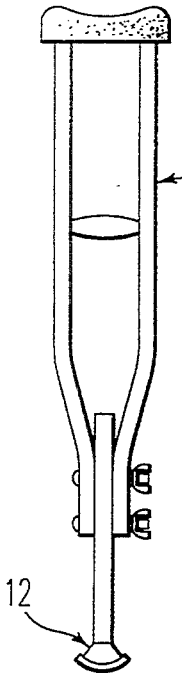
FIG. 1 is a side-elevational view of a crutch having an improved radial crutch tip assembly of this invention mounted thereon.
Figure 2:
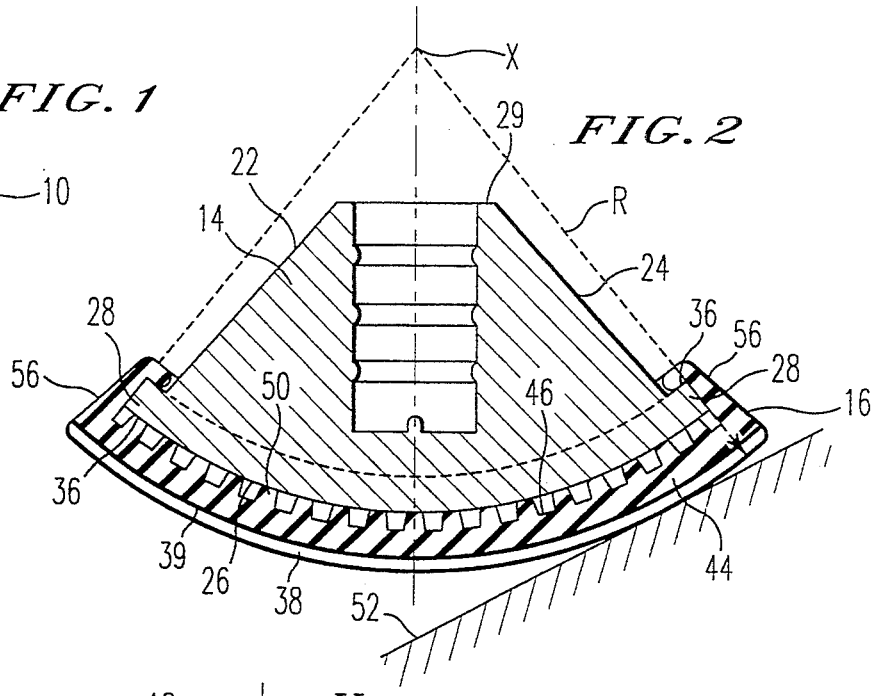
FIG. 2 is a more detailed side cross-sectional view of an improved radial crutch tip assembly of this invention taken on line II—II in FIG. 3.
Figure 3:
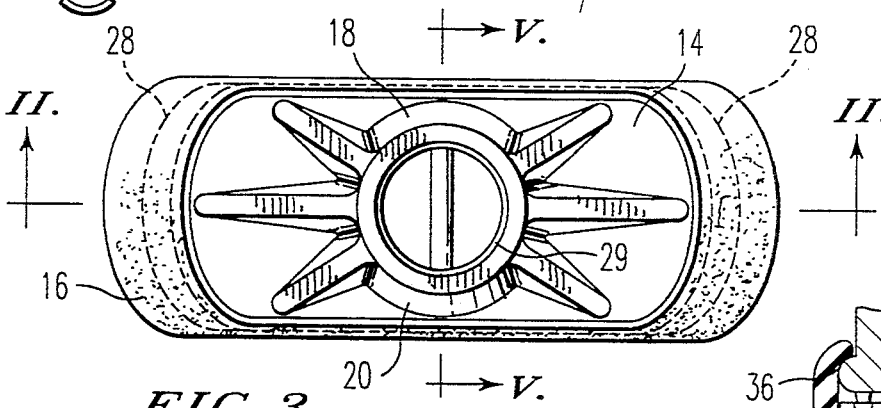
FIG. 3 is top plan view of the improved radial crutch tip assembly of FIG. 2.
Figure 4:
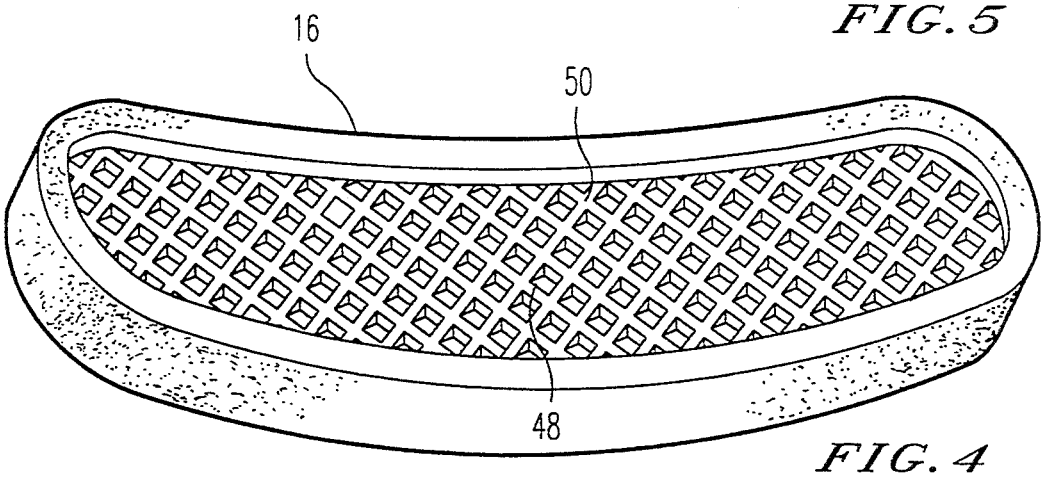
FIG. 4 is an isometric view of a boot of the improved radial crutch tip assembly of FIGS. 1–3.
Figure 6:
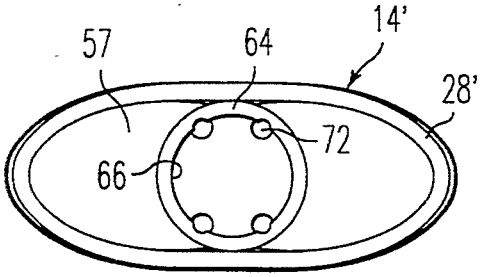
FIG. 6 is a top view of a base of a second embodiment of this invention.
Figure 8:
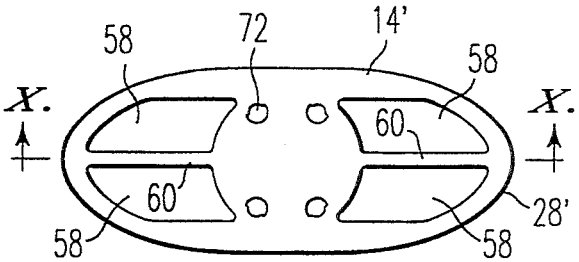
FIG. 8 is a bottom view of the base of the FIG. 6 embodiment.
Figure 7:
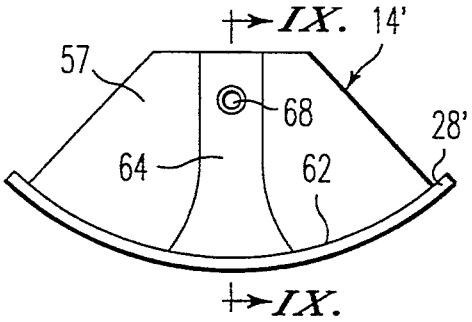
FIG. 7 is a side view of the base of the FIG. 6 embodiment.
Figure 9:
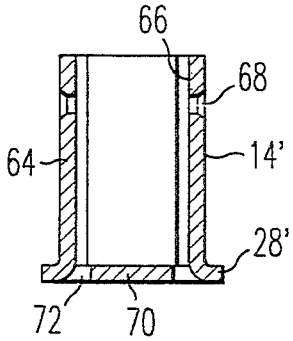
FIG. 9 is a cross-sectional view of the base of the FIGS. 6–8 embodiments taken on line IX—IX in FIG. 7.

A standard crutch 10, cane or walker (not shown) has an improved radial crutch tip assembly 12 at a lower-end tip thereof. A simplified embodiment of the improved radial crutch tip assembly 12 is depicted in FIGS. 2, 3 and 4. In this simplified embodiment, the crutch tip assembly 12 comprises a base 14 and a resilient boot 16. The base is molded as one solid piece of a very strong, yet lightweight resinous plastic such as polycarbonate sold under the Dupont trademark LEXAN. The base 14, in this embodiment, has first and second side surfaces 18 and 20, outwardly and downwardly tapered front and rear surfaces 22 and 24 and a convex bottom surface 26 forming an arc. It is the arc-shape of this convex bottom surface 26 from which the radial crutch tip assembly gets its name inasmuch as portions of the base 14 extending between the front and rear surfaces 22 and 24 form radii, or spokes, for supporting the arc-shaped convex bottom surface 26. The base 14 also includes a surrounding, peripheral, laterally-outwardly protruding lip 28 adjacent bottom edges of the first and second side surfaces 18 and 20 and the front and rear surfaces 22 and 24. A top surface 29 of the base 14 includes a structure for attaching the base 14 to the crutch 10, which structure is not particularly important to this invention. In this regard, a structure for accomplishing this is fully described in U.S. Pat. No. 5,103,850 to Davis and that description is incorporated herein by reference.

The resilient boot 16 is normally of a hard rubber and has the shape of an elongated rocker. The resilient boot defines a mounting cavity 36 in a top surface thereof and an elongated arch-shaped groove 38 in a lower surface thereof. The elongated arch-shaped groove 38 is so formed that there are traction shoulders 40 and 42 extending along each side of a bottom surface 39 having a treaded surface 76 therebetween. A bottom wall 44 of the boot 16 defines a top surface 46 which is in the cavity 36 of the boot and which is opposite to the bottom surface 26 of the base 14. The bottom wall 44 also forms the boot bottom surface 39.

Formed as a part of the sole 44 on the sole top surface 46 is a waffle-shaped grid 48 of protrusions. This is basically protruding walls 50 which extend upwardly from the sole 44. This can be seen most clearly in FIG. 2 where protruding walls, or projections, 50 are positioned between the sole top surface 46 and the base bottom surface 26. These protruding walls, or projections, 50, with spaces therebetween, form a cushion between the base bottom surface 26 and the sole top surface 46 so that when pressure is applied downwardly on the crutch 10, against a ground surface 52, as is shown in FIG. 2, the cushion formed by the projections 50 will "compress" and allow the sole 44 to move toward the base 14. This "give" forms an absorber which allows the sole bottom surface 39 to achieve better traction and also provides a shock-absorbing effect for a user of the crutch 10 to protect his joints and muscles and make his ambulatory movements more pleasant.

A significant aspect of this invention is that a radius R of the rounded sole bottom surface 39 is, or is approximately, 3.14 inches which is the approximate average distance of a human ankle joint from the bottom surface of its foot, or above ground. In other words, during ambulatory motion with the crutch 10, the radial crutch tip assembly 12 pivots, or rotates, about an axis X which is located about the same distance from the ground surface 52 as is an average ankle joint.

Figure 5:
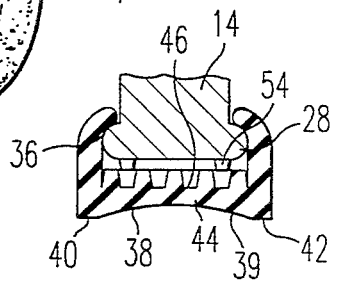
FIG. 5 is a cross-sectional view of an embellished embodiment of the improved radial crutch tip assembly of FIGS. 2–4, taken at line V—V in FIG. 3, although the FIG. 3 embodiment does not include the embellishment.

FIG. 5 discloses an embellishment of the FIGS. 2–4 embodiment of the invention in which the base 14 has downwardly extending ridges 54 thereon to contact the protruding wall grid 48. As is obvious to those of ordinary skill in the art, when one places a load on the crutch 10, the ridges 54 extend downwardly into the protrusion grid 48, thereby, again, creating a shock-absorbing effect. In this respect, the ridges 54 can extend down into the protrusion grid 48 more easily than can a base bottom surface 26.

Looking now at the embodiment of FIGS. 6–14 of the improved radial crutch tip assembly of this invention, a solid base 14' molded of a strong, yet lightweight, resinous plastic such as polycarbonate has a skirt 57 defining hollowed-out cavities 58 therein separated by supporting webs 60. In this regard, the supporting webs 60 provide support for the skirt 57. At a lower edge 62 of the skirt 57 is a protruding lip 28'. Positioned approximately in the middle of the skirt 57 is a crutch tip cylinder 64 defining a crutch tip cavity 66 for receiving a crutch tip. The crutch cylinder 64 has screw openings 68 therein for receiving screws (not shown) to hold the crutch tip in the crutch cylinder 64. The base 14' includes a bottom wall 70 for closing the bottom end of the crutch tip cavity 66, however, the cavities 58 are open at the bottom. The bottom wall 70 has openings 72 therein for allowing air to exit from the crutch cavity 66 when a crutch tip is extended thereinto.

Figure 10:
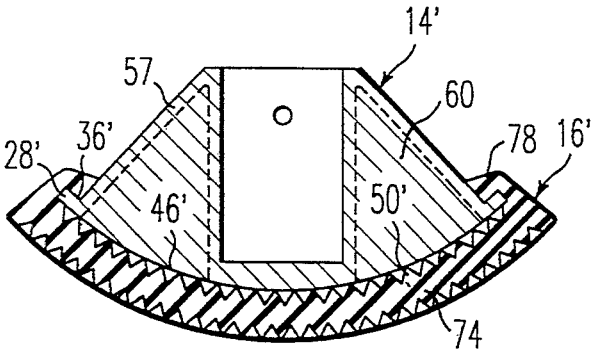
FIG. 10 is a side cross-sectional view of the base of FIGS. 6–9 taken on line X—X in FIG. 8, but also having a second embodiment boot thereon.
Figure 11:
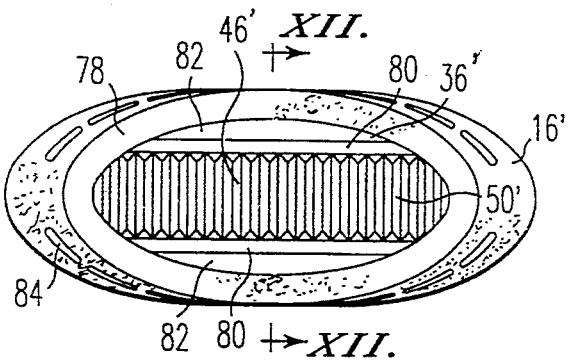
FIG. 11 is a top view of the boot of FIG. 10.
Figure 12:
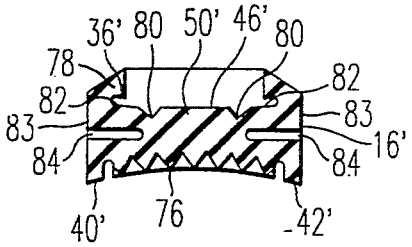
FIG. 12 is a cross-sectional view taken on line XII—XII in FIG. 11.
Figure 13:
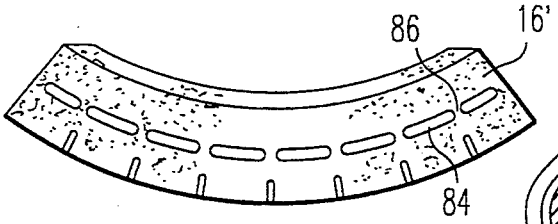
FIG. 13 is a side view of the boot of FIGS. 10–12.
Figure 14:
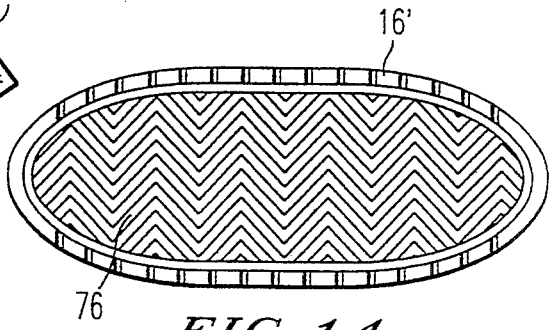
FIG. 14 is a bottom view of the boot of FIGS. 10–13.

A boot 16', depicted in FIGS. 10–14, is shown mounted on the base 14' in FIG. 10. The boot 16' has a sole 74 with a tread 76 on a bottom surface thereof. The boot 16' defines a cavity 36' into which the protruding lip 28' of the base 14' is inserted. In this regard, a flange 78 of the boot 16' extends over the protruding lip 28' to hold the boot 16' on the base 14'. A sole top surface 46' has a series of protruding ridges, or teeth, 50' thereon extending cross-wise to the length of the boot 16', but being situated adjacent to one another to form a row of ridges 50' extending lengthwise with the boot 16'. Ends of the tooth-like ridges 50' terminate at grooves 80 positioned at opposite ends of the ridges. Positioned on the other sides of the grooves 80 are plateaus 82 which have a height which is approximately the same as the height of the ridges 50'. Thus, a bottom surface of the protruding lip 28' impinges on, or rests on, the plateaus 82 while bottom surfaces of the supporting webs 60 and a bottom surface of the bottom wall 70 rest mainly on the protruding ridges 50'.

Extending inwardly from exterior side surfaces 83 of the boot 16', below the plateaus 82, are lines of flat cavities 84, or sidewall cavities, which allow the plateaus 82 to be compressed downwardly to a greater extent than if the flat cavities 84 were not there.

In operation of the FIGS. 6–14 embodiment of the improved radial crutch tip assembly of this invention, the base 14' is, of course, mounted on a crutch tip by inserting the crutch tip into the crutch cavity 66, and the boot 16' is mounted on the base 14' by inserting the protruding lip 28' of the base 14' into the cavity 36' of the boot 16'. When one uses a crutch having this improved radial crutch tip assembly of this invention mounted thereon, the base 14' is cushioned relative to the tread 76 of the sole 74 by means of the supporting web 60 and the bottom wall 70 compressing the protruding ridges 50' and the protruding lip 28' compressing supporting walls 86 between the flat cavities 84 by pressing on the plateaus 82. It will be understood by those of ordinary skill in the art that when a crutch is placed outwardly, to the side, of an individual, pressure on traction shoulders 40' and 42' will cause the flat cavities 84 to close, thereby allowing the traction shoulders 40' and 42' to compress, thereby creating better traction at the tread 76. Similarly, the "give" provided by the protruding ridges 50' and the flat cavities 84 protect the joints and muscles of the user and make his ambulatory movements more pleasant. Additionally, the "give" allows the boot to conform to irregularities and debris on floor surfaces 52.

Figure 15:
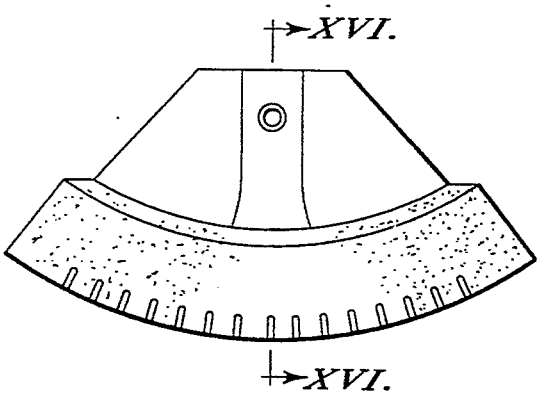
FIG. 15 is a side view of a third embodiment of the improved radial crutch tip assembly of this invention.
Figure 16:
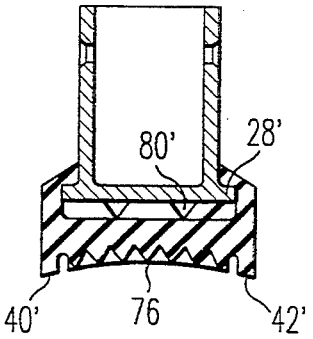
FIG. 16 is a cross-sectional view taken on line XVI—XVI in FIG. 15.
Figure 17:
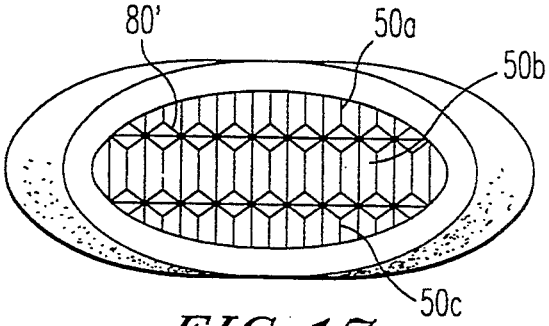
FIG. 17 is a top view of the boot of FIGS. 15 and 16.

FIGS. 15–17 depict another embodiment of this invention which is substantially similar to the embodiments of FIGS. 6–14 with the exception that there are three rows of protruding ridges **50*a*, 50*b* and 50*c*. In this embodiment, the side rows of ridges 50*a* and 50*c* replace the plateaus 82 and the flat cavities 84 of the FIGS. 6–14 embodiment. That is, the side rows of the protruding ridges 50*a* and 50*c* easily compress when impinged on by a bottom edge surface of the skirt 57, that is the protruding lip 28', so as to allow deflection of the traction shoulders 40'' and 42'' so that the tread 76** can achieve a desired traction.

In one embodiment, not depicted, there are three ridges rather than two as are depicted in FIG. 5. Also, in one embodiment, the ridges 54 extend downwardly toward the protrusion grid 48 to the greatest extent at the center, halfway between rocker ends 56, of the sole bottom surface. However, as the ridges near the rocker ends 56, they protrude less and less from the base bottom surface 26 until, at the ends 56, the ridges 54 merge into the base bottom surface 26.

It is particularly advantageous that the radial crutch tip assembly of this invention pivots about an axis that is located approximately the same distance above a ground surface as does a human ankle joint because in this manner the motion of the crutch 10 is more familiar to, and therefore more comfortable to, its user. In this regard, a user can also more easily coordinate the motion of his feet with that of the crutches.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

What is claimed is:

1. An improved radial crutch tip assembly comprising:

a crutch tip base having outwardly and downwardly tapered front and rear surfaces, side surfaces and a convex base bottom surface forming an approximate arc which curves in a direction of elongation, said base further including a lip protruding laterally outwardly adjacent said base bottom surface, said base being molded of a solid material, but defining at least one hollowed-out cavity, surrounded by a skirt and being open at said base bottom surface;

a resilient boot having the shape of a rocker, said resilient boot defining a mounting cavity for receiving said base bottom surface and said lip for holding said boot on said base, said boot further having a sole forming a bottom wall thereof.

2. A crutch tip assembly as in claim 1 wherein there are a plurality of hollowed-out cavities, all being surrounded by said skirt and all being open at the base bottom surface.

3. A crutch tip assembly as in claim 2 wherein there are four hollowed-out cavities surrounded by said skirt, said cavities being open at said base bottom surface, with cavity pairs being respectively separated by webs formed of said solid material.

4. A crutch tip as in claim 1 wherein said sole defines a rounded, convex, sole bottom surface having a radius which is approximately the same as a distance of an average human ankle joint from a bottom surface of its foot.

5. A crutch tip assembly as in claim 4 wherein the radius is approximately 3.14 inches.

* * * * *